US010045140B2

(12) United States Patent
Rossum et al.

(10) Patent No.: US 10,045,140 B2
(45) Date of Patent: Aug. 7, 2018

(54) UTILIZING DIGITAL MICROPHONES FOR LOW POWER KEYWORD DETECTION AND NOISE SUPPRESSION

(71) Applicant: Knowles Electronics, LLC, Itasca, IL (US)

(72) Inventors: David P. Rossum, Santa Cruz, CA (US); Niel D. Warren, Soquel, CA (US)

(73) Assignee: Knowles Electronics, LLC, Itasca, IL (US)

( * ) Notice: Subject to any disclaimer, the term of this patent is extended or adjusted under 35 U.S.C. 154(b) by 88 days.

(21) Appl. No.: 14/989,445

(22) Filed: Jan. 6, 2016

(65) Prior Publication Data

US 2016/0196838 A1 Jul. 7, 2016

Related U.S. Application Data

(60) Provisional application No. 62/100,758, filed on Jan. 7, 2015.

(51) Int. Cl.
*H04R 1/40* (2006.01)
*H04R 29/00* (2006.01)
(Continued)

(52) U.S. Cl.
CPC ..... *H04R 29/004* (2013.01); *G10L 21/0208* (2013.01); *G10L 2015/088* (2013.01);
(Continued)

(58) Field of Classification Search
CPC ..... H04R 3/005; H04R 2410/05; H04R 2410/01; H04R 29/004; G10L 21/0208; G10L 2015/088
(Continued)

(56) References Cited

U.S. PATENT DOCUMENTS 3,989,897 A 11/1976 Carver
4,811,404 A 3/1989 Vilmur et al.
(Continued)

FOREIGN PATENT DOCUMENTS

EP 1081685 A2 3/2001
FI 20126106 1/2013
(Continued)

OTHER PUBLICATIONS

International Search Report & Written Opinion dated Sep. 11, 2014 in Application No. PCT/US2014/033559, filed Jan. 9, 2014.
(Continued)

*Primary Examiner* — Paul S Kim
(74) *Attorney, Agent, or Firm* — Foley & Lardner LLP

(57) ABSTRACT

Provided are systems and methods for utilizing digital microphones in low power keyword detection and noise suppression. An example method includes receiving a first acoustic signal representing at least one sound captured by a digital microphone. The first acoustic signal includes buffered data transmitted with a first clock frequency. The digital microphone may provide voice activity detection. The example method also includes receiving at least one second acoustic signal representing the at least one sound captured by a second microphone, the at least one second acoustic signal including real-time data. The first and second acoustic signals are provided to an audio processing system which may include noise suppression and keyword detection. The buffered portion may be sent with a higher, second clock frequency to eliminate a delay of the first acoustic signal from the second acoustic signal. Providing the signals may also include delaying the second acoustic signal.

24 Claims, 5 Drawing Sheets

(51) Int. Cl.
*G10L 15/08* (2006.01)
*G10L 21/0208* (2013.01)
*H04R 3/00* (2006.01)

(52) U.S. Cl.
CPC ..... *H04R 3/005* (2013.01); *H04R 2410/01* (2013.01); *H04R 2410/05* (2013.01)

(58) Field of Classification Search
USPC ..... 381/97, 122
See application file for complete search history.

(56) References Cited

U.S. PATENT DOCUMENTS 4,812,996 A 3/1989 Stubbs
5,012,519 A 4/1991 Adlersberg et al.
5,335,312 A 8/1994 Mekata et al.
5,340,316 A 8/1994 Javkin et al.
5,473,702 A 12/1995 Yoshida et al.
5,828,997 A 10/1998 Durlach et al.
5,886,656 A 3/1999 Feste et al.
6,138,101 A 10/2000 Fujii
6,381,570 B2 4/2002 Li et al.
6,449,586 B1 9/2002 Hoshuyama
6,483,923 B1 11/2002 Marash
6,594,367 B1 7/2003 Marash et al.
6,876,859 B2 4/2005 Anderson et al.
7,319,959 B1 1/2008 Watts
7,346,176 B1 3/2008 Bernardi et al.
7,373,293 B2 5/2008 Chang et al.
7,539,273 B2 5/2009 Struckman
7,873,114 B2 1/2011 Lin
7,957,542 B2 6/2011 Sarrukh et al.
7,986,794 B2 7/2011 Zhang
8,005,238 B2 8/2011 Tashev et al.
8,111,843 B2 2/2012 Logalbo et al.
8,112,272 B2 2/2012 Nagahama et al.
8,155,346 B2 4/2012 Yoshizawa et al.
8,184,822 B2 5/2012 Carreras et al.
8,184,823 B2 5/2012 Itabashi et al.
8,204,253 B1 6/2012 Solbach
8,447,045 B1 5/2013 Laroche
8,538,035 B2 9/2013 Every et al.
8,606,571 B1 12/2013 Every et al.
8,712,776 B2 4/2014 Bellegarda et al.
8,958,572 B1 2/2015 Solbach
2002/0106092 A1 8/2002 Matsuo
2002/0138265 A1 9/2002 Stevens et al.
2005/0060155 A1 3/2005 Chu et al.
2005/0171851 A1 8/2005 Applebaum et al.
2006/0074693 A1 4/2006 Yamashita
2007/0053522 A1 3/2007 Murray et al.
2007/0076896 A1 4/2007 Hosaka et al.
2007/0088544 A1 4/2007 Acero et al.
2007/0154031 A1 7/2007 Avendano et al.
2007/0253574 A1 11/2007 Soulodre
2008/0019548 A1* 1/2008 Avendano ..... H04R 3/005 381/313
2008/0147397 A1 6/2008 Konig et al.
2008/0170716 A1 7/2008 Zhang
2008/0195389 A1 8/2008 Zhang et al.
2008/0232607 A1 9/2008 Tashev et al.
2008/0260175 A1 10/2008 Elko
2009/0012783 A1 1/2009 Klein
2009/0012786 A1 1/2009 Zhang et al.
2009/0022335 A1 1/2009 Konchitsky et al.
2009/0024392 A1 1/2009 Koshinaka
2009/0055170 A1 2/2009 Nagahama
2009/0067642 A1 3/2009 Buck et al.
2009/0146848 A1 6/2009 Ghassabian
2009/0164212 A1 6/2009 Chan et al.
2009/0175466 A1 7/2009 Elko et al.
2009/0304203 A1 12/2009 Haykin et al.
2009/0323982 A1 12/2009 Solbach et al.
2010/0082346 A1 4/2010 Rogers et al.
2010/0082349 A1 4/2010 Bellegarda et al.
2010/0121629 A1 5/2010 Cohen
2010/0135508 A1* 6/2010 Wu ..... H04R 3/00 381/122
2010/0324894 A1 12/2010 Potkonjak
2011/0026739 A1* 2/2011 Thomsen ..... H03F 1/3211 381/120
2011/0038489 A1 2/2011 Visser et al.
2011/0064242 A1* 3/2011 Parikh ..... G10L 21/0272 381/94.2
2011/0099010 A1 4/2011 Zhang
2011/0103626 A1 5/2011 Bisgaard et al.
2011/0164761 A1 7/2011 McCowan
2011/0218805 A1 9/2011 Washio et al.
2011/0274291 A1 11/2011 Tashev et al.
2011/0299695 A1 12/2011 Nicholson
2012/0027218 A1 2/2012 Every et al.
2013/0197920 A1* 8/2013 Lesso ..... H04L 25/4902 704/500
2013/0289988 A1 10/2013 Fry
2013/0289996 A1 10/2013 Fry
2014/0316783 A1 10/2014 Medina
2015/0030163 A1 1/2015 Sokolov

FOREIGN PATENT DOCUMENTS

JP 2013527493 A 6/2013
KR 1020130108063 10/2013
TW 200933609 A 8/2009
TW 201205560 A 2/2012
TW I466107 B 12/2014
WO WO2011137258 A1 11/2011
WO WO2012094422 A2 7/2012
WO WO2014172167 A1 10/2014

OTHER PUBLICATIONS

Hinton, G. et al., "Deep Neural Networks for Acoustic Modeling in Speech Recognition", IEEE Signal Processing Magazine, Nov. 2012, pp. 82-97.
International Search Report & Written Opinion dated Feb. 12, 2016 in Patent Cooperation Treaty Application No. PCT/US2015/064523, filed Dec. 8, 2015.
Nandy, Dibyendu et al., "Microphone Apparatus and Method with Catch-Up Buffer," U.S. Appl. No. 14/797,310, filed Jul. 13, 2015.
Non-Final Office Action, dated Jan. 16, 2013, U.S. Appl. No. 12/832,920, filed Jul. 8, 2010.
Notice of Allowance, dated May 13, 2013, U.S. Appl. No. 12/832,920, filed Jul. 8, 2010.
Non-Final Office Action, dated Mar. 28, 2013, U.S. Appl. No. 12/837,340, filed Jul. 15, 2010.
Notice of Allowance, dated Jul. 25, 2013, U.S. Appl. No. 12/837,340, filed Jul. 15, 2010.
Non-Final Office Action, dated Dec. 5, 2012, U.S. Appl. No. 12/855,600, filed Aug. 12, 2010.
Final Office Action, dated May 7, 2013, U.S. Appl. No. 12/855,600, filed Aug. 12, 2010.
Notice of Allowance, dated Sep. 30, 2014, U.S. Appl. No. 12/855,600, filed Aug. 12, 2010.
Non-Final Office Action, dated Aug. 15, 2012, U.S. Appl. No. 12/876,861, filed Sep. 7, 2010.
Notice of Allowance, dated Jan. 28, 2013, U.S. Appl. No. 12/876,861, filed Sep. 7, 2010.
Non-Final Office Action, dated Aug. 15, 2013, U.S. Appl. No. 12/876,861, filed Sep. 7, 2010.
International Search Report and Written Opinion dated Jul. 21, 2011 in Patent Cooperation Treaty Application No. PCT/US11/34373.
Hoshuyama et al., "A Robust Generalized Sidelobe Canceller with a Blocking Matrix Using Leaky Adaptive Filters" 1997.
Spriet et al., "The impact of speech detection errors on the noise reduction performance of multi-channel Wiener filtering and Generalized Sidelobe Cancellation" 2005.
Hoshuyama et al., "A Robust Adaptive Beamformer for Microphone Arrays with a Blocking Matrix Using Constrained Adaptive Filters" 1999.

(56) References Cited

OTHER PUBLICATIONS

Herbordt et al., "Frequency-Domain Integration of Acoustic Echo Cancellation and a Generalized Sidelobe Canceller with Improved Robustness" 2002.
Office Action dated Jun. 5, 2014 in Taiwan Patent Application 100115214, filed Apr. 29, 2011.
Notice of Allowance dated Nov. 7, 2014 in Taiwan Application No. 100115214, filed Apr. 29, 2011.
Office Action dated Jun. 23, 2015 in Japan Patent Application 2013-508256 filed Apr. 28, 2011.
Office Action dated Jun. 23, 2015 in Finland Patent Application 20126106 filed Apr. 28, 2011.
International Search Report and Written Opinion dated Apr. 1, 2016 in Patent Cooperation Treaty Application No. PCT/US2016/012349.

* cited by examiner

UTILIZING DIGITAL MICROPHONES FOR LOW POWER KEYWORD DETECTION AND NOISE SUPPRESSION

CROSS-REFERENCE TO RELATED APPLICATION

The present application claims the benefit of U.S. Provisional Patent Application No. 62/100,758, filed Jan. 7, 2015. The subject matter of the aforementioned application is incorporated herein by reference for all purposes.

FIELD

The present application relates generally to audio processing and, more specifically, to systems and methods for utilizing digital microphones for low power keyword detection and noise suppression.

BACKGROUND

A typical method of keyword detection is a three stage process. The first stage is vocalization detection. Initially, an extremely low power "always-on" implementation continuously monitors ambient sound and determines whether a person begins to utter a possible keyword (typically by detecting human vocalization). When a possible keyword vocalization is detected, the second stage begins.

The second stage performs keyword recognition. This operation consumes more power because it is computationally more intensive than the vocalization detection. When the examination of an utterance (e.g., keyword recognition) is complete, the result can either be a keyword match (in which case the third stage will be entered) or no match (in which case operation of the first, lowest power stage resumes).

The third stage is used for analysis of any speech subsequent to the keyword recognition using automatic speech recognition (ASR). This third stage is a very computationally intensive process and, therefore, can greatly benefit from improvements to the signal to noise ratio (SNR) of the portion of the audio that includes the speech. The SNR is typically optimized using noise suppression (NS) signal processing, which may require obtaining audio input from multiple microphones.

Use of a digital microphone (DMIC) is well known. The DMIC typically includes a signal processing portion. A digital signal processor (DSP) is typically used to perform computations for detecting keywords. Having some form of digital signal processor (DSP), to perform the keyword detection computations, on the same integrated circuit (chip) as the signal processing portion of the DMIC itself may have system power benefits. For example, while in the first stage, the DMIC can operate from an internal oscillator, thus saving the power of supplying an external clock to the DMIC and the power of transmitting the DMIC data output, typically, a pulse density modulated (PDM) signal, to an external DSP device.

It is also known that implementing the subsequent stages of keyword recognition on the DMIC may not be optimal for the lowest power or system cost. The subsequent stages of keyword recognition are computationally intensive and, thus, consume significant dynamic power and die area. However, the DMIC signal processing chip is typically implemented using a process geometry having significantly higher dynamic power and larger area per gate or memory bit than the best available digital processes.

Finding an optimal implementation that takes advantage of the potential power savings of implementing the first stage of keyword recognition in the DMIC can be challenging due to conflicting requirements. To optimize power, the DMIC operates in an "always-on," standalone manner, without transmitting audio data to an external device when no vocalization has been detected. When the vocalization is detected, the DMIC needs to provide a signal to an external device indicating this condition. Simultaneously with or subsequent to the occurrence of this condition, the DMIC needs to begin providing audio data to the external device(s) performing the subsequent stages. Optimally, the audio data interface is needed to meet the following requirements: transmitting audio data corresponding to times that significantly precede the vocalization detection, transmitting real-time audio data at an externally provided clock (sample) rate, and simplifying multi-microphone noise suppression processing. Additionally, latency associated with the real-time audio data for DMICs that implement the first stage of keyword recognition needs to be substantially the same as for conventional DMICs, the interface needs to be compatible with existing interfaces, the interface needs to indicate the clock (sample) rate used while operating with the internal oscillator, and no audio drop-outs should occur.

An interface with a DMIC that implement the first stage of keyword recognition can be challenging to implement largely due to the requirement to present audio data that is buffered significantly prior to the vocalization detection. This buffered audio data was previously acquired at a sample rate determined by the internal oscillator. Consequently, when the buffered audio data is provided along with real-time audio data as part of a single, contiguous audio stream, it can be difficult to make this real-time audio data have the same latency as in a conventional DMIC or difficult to use conventional multi-microphone noise suppression techniques.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Systems and methods for utilizing digital microphones for low power keyword detection and noise suppression are provided. An example method includes receiving a first acoustic signal representing at least one sound captured by a digital microphone, the first acoustic signal including buffered data transmitted on a single channel with a first clock frequency. The example method also includes receiving at least one second acoustic signal representing the at least one sound captured by at least one second microphone. The at least one second acoustic signal may include real-time data. In some embodiments, the at least one second microphone may be an analog microphone. The at least one second microphone may also be a digital microphone that does not have voice activity detection functionality.

The example method further includes providing the first acoustic signal and the at least one second acoustic signal to an audio processing system. The audio processing system may provide at least noise suppression.

In some embodiments, the buffered data is sent with a second clock frequency higher than the first clock frequency, to eliminate a delay of the first acoustic signal from the second acoustic signal.

Providing the signals may include delaying the second acoustic signal.

Other example embodiments of the disclosure and aspects will become apparent from the following description taken in conjunction with the following drawings.

BRIEF DESCRIPTION OF THE DRAWINGS

Embodiments are illustrated by way of example and not limitation in the figures of the accompanying drawings, in which like references indicate similar elements.

DETAILED DESCRIPTION

The present disclosure provides example systems and methods for utilizing digital microphones for low power keyword detection and noise suppression. Various embodiments of the present technology can be practiced with mobile audio devices configured at least to capture audio signals and may allow improving automatic speech recognition in the captured audio.

In various embodiments, mobile devices are hand-held devices, such as, notebook computers, tablet computers, phablets, smart phones, personal digital assistants, media players, mobile telephones, video cameras, and the like. The mobile devices may be used in stationary and portable environments. The stationary environments can include residential and commercial buildings or structures and the like. For example, the stationary environments can further include living rooms, bedrooms, home theaters, conference rooms, auditoriums, business premises, and the like. Portable environments can include moving vehicles, moving persons, other transportation means, and the like.

Figure 1:
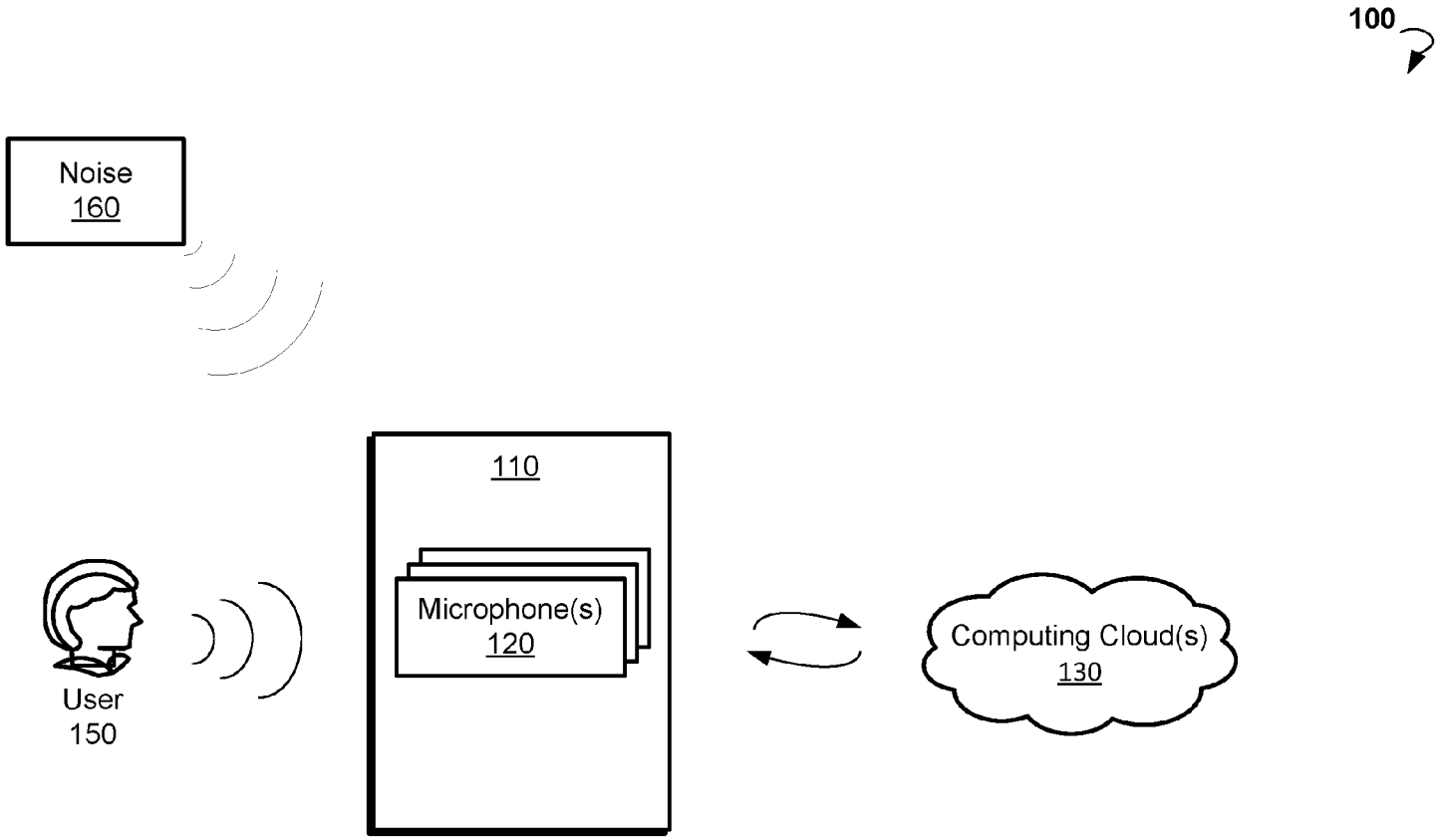
FIG. 1 is a block diagram illustrating a system, which can be used to implement methods for utilizing digital microphones for low power keyword detection and noise suppression, according to various example embodiments.

Referring now to FIG. 1, an example system 100 in which methods of the present disclosure can be practiced is shown. The system 100 can include a mobile device 110. In various embodiments, the mobile device 110 includes microphone(s) (e.g., transducer(s)) 120 configured to receive voice input/acoustic signal from a user 150.

The voice input/acoustic sound can be contaminated by a noise 160. Noise sources can include street noise, ambient noise, speech from entities other than an intended speaker(s), and the like. For example, noise sources can include a working air conditioner, ventilation fans, TV sets, mobile phones, stereo audio systems, and the like. Certain kinds of noise may arise from both operation of machines (for example, cars) and the environments in which they operate, for example, a road, track, tire, wheel, fan, wiper blade, engine, exhaust, entertainment system, wind, rain, waves, and the like noises.

In some embodiments, the mobile device 110 is commutatively connected to one or more cloud-based computing resources 130, also referred to as a computing cloud(s) 130 or a cloud 130. The cloud-based computing resource(s) 130 can include computing resources (hardware and software) available at a remote location and accessible over a network (for example, the Internet or a cellular phone network). In various embodiments, the cloud-based computing resource(s) 130 are shared by multiple users and can be dynamically re-allocated based on demand. The cloud-based computing resource(s) 130 can include one or more server farms/clusters, including a collection of computer servers which can be co-located with network switches and/or routers.

Figure 2:
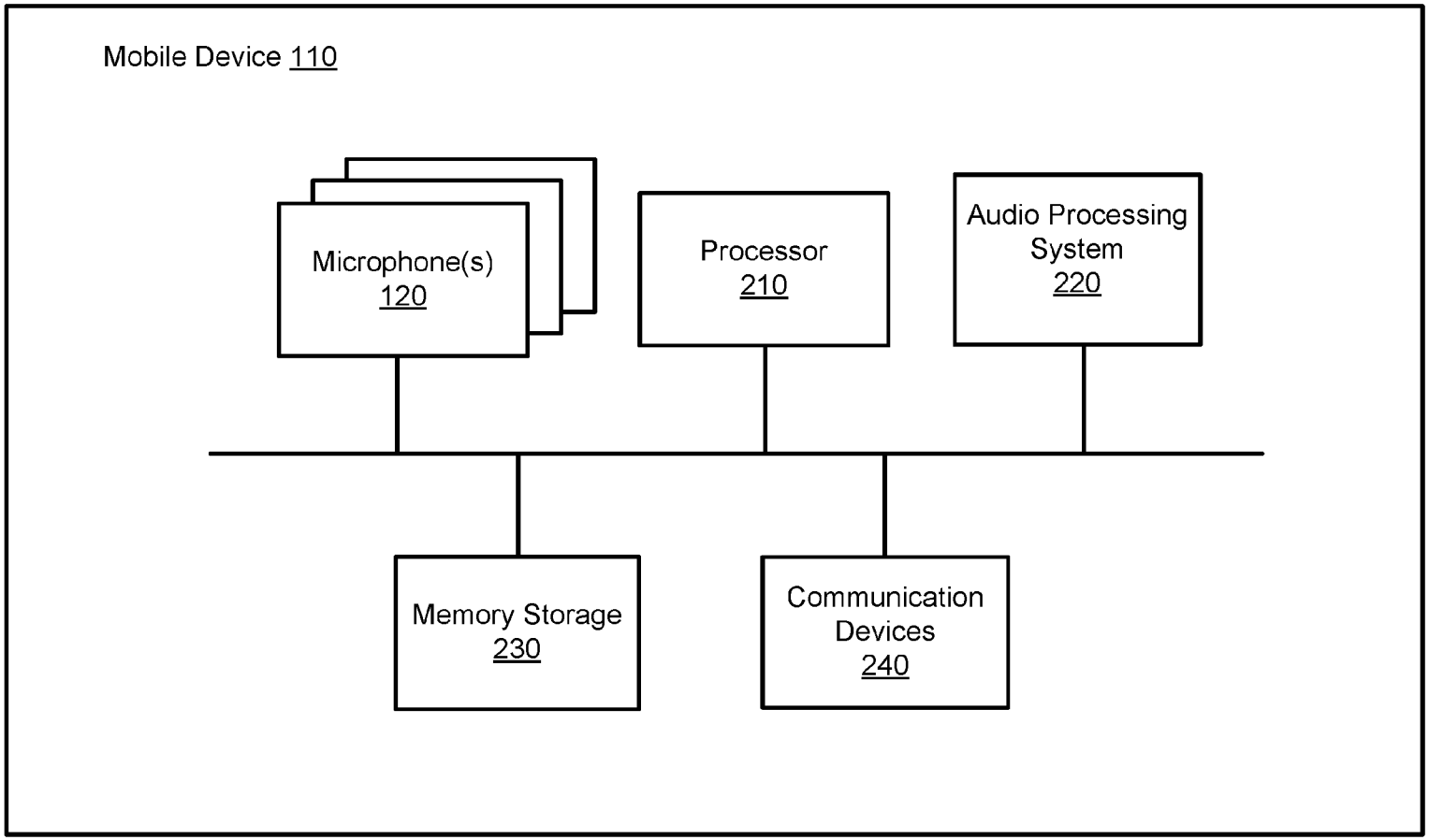
FIG. 2 is a block diagram of an example mobile device, in which methods for utilizing digital microphones for low power keyword detection and noise suppression can be practiced.

FIG. 2 is a block diagram showing components of the mobile device 110, according to various example embodiments. In the illustrated embodiment, the mobile device 110 includes one or more microphone(s) 120, a processor 210, audio processing system 220, a memory storage 230, and one or more communication devices 240. In certain embodiments, the mobile device 110 also includes additional or other components necessary for operations of mobile device 110. In other embodiments, the mobile device 110 includes fewer components that perform similar or equivalent functions to those described with reference to FIG. 2.

In various embodiments, where the microphone(s) 120 include multiple omnidirectional microphones closely spaced (e.g., 1-2 cm apart), a beam-forming technique can be used to simulate a forward-facing and a backward-facing directional microphone response. In some embodiments, a level difference can be obtained using the simulated forward-facing and the backward-facing directional microphones. The level difference can be used to discriminate between speech and noise in, for example, the time-frequency domain, which can be further used in noise and/or echo reduction. Noise reduction may include noise cancellation and/or noise suppression. In certain embodiments, some microphone(s) 120 are used mainly to detect speech and other microphones are used mainly to detect noise. In yet other embodiments, some microphones are used to detect both noise and speech.

In some embodiments, the acoustic signals, once received, for example, captured by microphone(s) 120, are converted into electric signals, which, in turn, are converted, by the audio processing system 220, into digital signals for processing in accordance with some embodiments. The processed signals may be transmitted for further processing to the processor 210. In some embodiments, some of the microphones 120 are digital microphone(s) operable to capture the acoustic signal and output a digital signal. Some of the digital microphone(s) may provide for voice activity detection (also referred to herein as vocalization detection) and buffering of the audio data significantly prior to the vocalization detection.

Audio processing system 220 can be operable to process an audio signal. In some embodiments, the acoustic signal is captured by the microphone(s) 120. In certain embodiments, acoustic signals detected by the microphone(s) 120 are used by audio processing system 220 to separate desired speech (for example, keywords) from the noise, providing more robust automatic speech recognition (ASR).

An example audio processing system suitable for performing noise suppression is discussed in more detail in U.S. patent application Ser. No. 12/832,901 (now U.S. Pat. No. 8,473,287), entitled "Method for Jointly Optimizing Noise Reduction and Voice Quality in a Mono or Multi-Microphone System," filed Jul. 8, 2010, the disclosure of which is incorporated herein by reference for all purposes. By way of example and not limitation, noise suppression methods are described in U.S. patent application Ser. No. 12/215,980 (now U.S. Pat. No. 9,185,487), entitled "System and Method for Providing Noise Suppression Utilizing Null Processing Noise Subtraction," filed Jun. 30, 2008, and in U.S. patent application Ser. No. 11/699,732 (now U.S. Pat. No. 8,194,880), entitled "System and Method for Utilizing Omni-Directional Microphones for Speech Enhancement," filed Jan. 29, 2007, which are incorporated herein by reference in their entireties.

Various methods for restoration of noise reduced speech are also described in commonly assigned U.S. patent application Ser. No. 13/751,907 (now U.S. Pat. No. 8,615,394), entitled "Restoration of Noise-Reduced Speech," filed Jan. 28, 2013, which is incorporated herein by reference in its entirety.

The processor 210 may include hardware and/or software operable to execute computer programs stored in the memory storage 230. The processor 210 can use floating point operations, complex operations, and other operations needed for implementations of embodiments of the present disclosure. In some embodiments, the processor 210 of the mobile device 110 includes, for example, at least one of a digital signal processor (DSP), image processor, audio processor, general-purpose processor, and the like.

The example mobile device 110 is operable, in various embodiments, to communicate over one or more wired or wireless communications networks, for example, via communication devices 240. In some embodiments, the mobile device 110 sends at least audio signal (speech) over a wired or wireless communications network. In certain embodiments, the mobile device 110 encapsulates and/or encodes the at least one digital signal for transmission over a wireless network (e.g., a cellular network).

The digital signal can be encapsulated over Internet Protocol Suite (TCP/IP) and/or User Datagram Protocol (UDP). The wired and/or wireless communications networks can be circuit switched and/or packet switched. In various embodiments, the wired communications network(s) provide communication and data exchange between computer systems, software applications, and users, and include any number of network adapters, repeaters, hubs, switches, bridges, routers, and firewalls. The wireless communications network(s) include any number of wireless access points, base stations, repeaters, and the like. The wired and/or wireless communications networks may conform to an industry standard(s), be proprietary, and combinations thereof. Various other suitable wired and/or wireless communications networks, other protocols, and combinations thereof, can be used.

Figure 3:
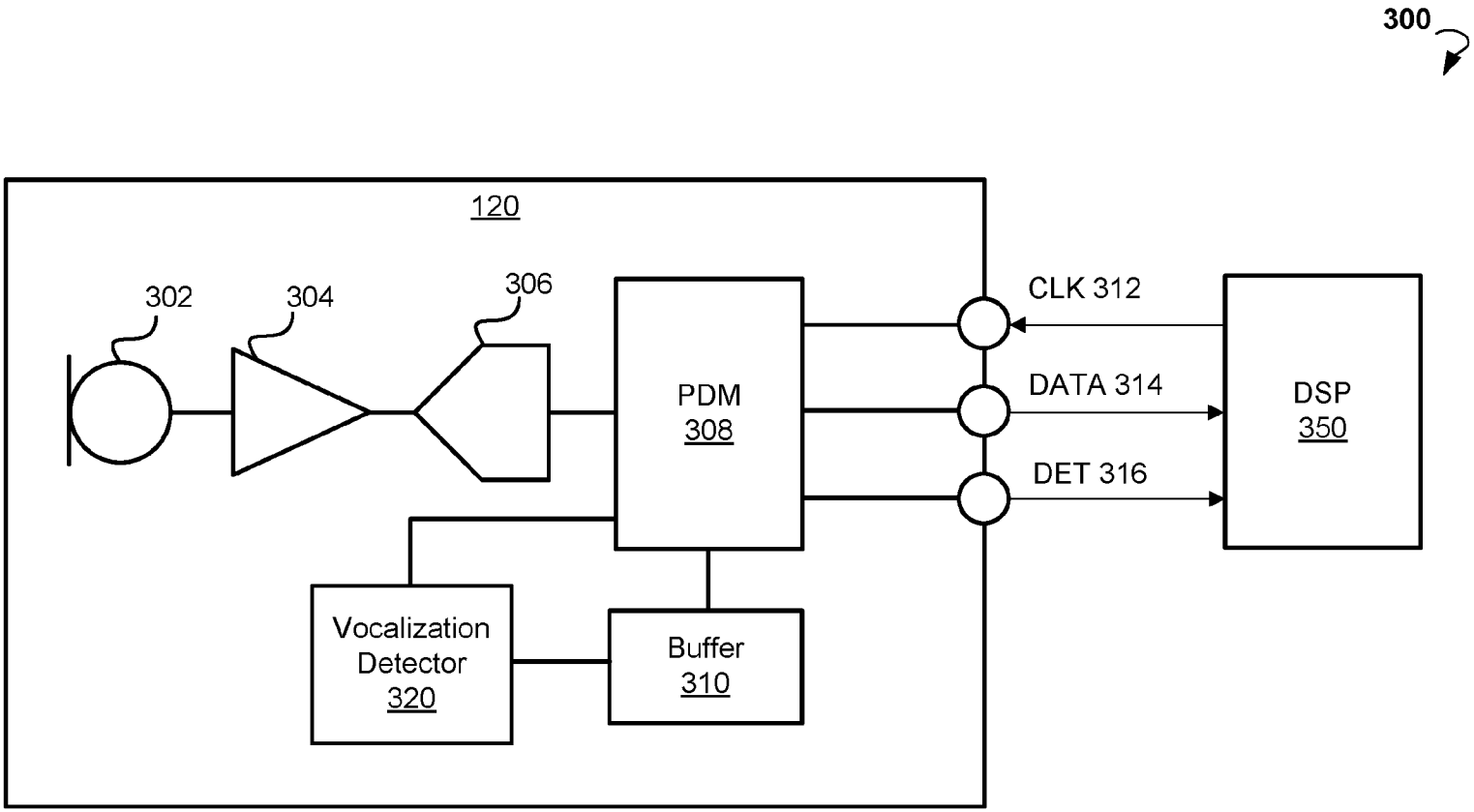
FIG. 3 is a block diagram showing a system for utilizing digital microphones for low power keyword detection and noise suppression, according to various example embodiments.

FIG. 3 is a block diagram showing a system 300 suitable for utilizing digital microphones for low power keyword detection and noise suppression, according to various example embodiments. The system 300 includes microphone(s) (also variously referred to herein as DMIC(s)) 120 coupled to a (external or host) DSP 350. In some embodiments, the digital microphone 120 includes a transducer 302, an amplifier 304, an analog-to-digital converter 306, and a pulse-density modulator (PDM) 308. In certain embodiments, the digital microphone 120 includes a buffer 310 and a vocalization detector 320. In other embodiments, the DMIC 120 interfaces with a conventional stereo DMIC interface. The conventional stereo DMIC interface includes a clock (CLK) input (or CLK line) 312 and a data (DATA) output 314. The data output includes a left channel and a right channel. In some embodiments, the DMIC interface includes an additional vocalization detector (DET) output (or DET line) 316. The CLK input 312 can be supplied by DSP 350. The DSP 350 can receive the DATA output 314 and DET output 316. In some embodiments, digital microphone 120 produces a real-time digital audio data stream, typically via PDM 308. An example digital microphone the provides vocalization detection is discussed in more detail in U.S. patent application Ser. No. 14/797,310, entitled "Microphone Apparatus and Method with Catch-up Buffer," filed Jul. 13, 2015, the disclosure of which is incorporated herein by reference for all purposes.

Example 1

In various embodiments, under first stage conditions, the DMIC 120 operates on an internal oscillator, which determines the internal sample rate during this condition. Under first stage conditions, prior to the vocalization detection, the CLK line 312 is static, typically, a logical 0. The DMIC 120 outputs a static signal, typically, a logical 0, on both the DATA output 314 and DET output 316. Internally, the DMIC 120 operating from its internal oscillator, can be operable to analyze the audio data to determine whether a vocalization has occurred. Internally, the DMIC 120 buffers the audio data into a recirculating memory (for example, using buffer 310). In certain embodiments, the recirculating memory has a pre-determined number (typically about 100 k of PDM) of samples.

In various exemplary embodiments, when the DMIC 120 detects a vocalization, the DMIC 120 begins outputting PDM 308 sample clock, derived from the internal oscillator, on the DET output 316. The DSP 350 can be operable to detect the activity on the DET line 316. The DSP 350 can use this signal to determine the internal sample rate of the DMIC 120 with a sufficient accuracy for further operations. Then the DSP 350 can output a clock on the CLK line 312 appropriate for receiving real-time PDM 308 audio data from the DMIC 120 via the conventional DMIC 120 interface protocol. In some embodiments, the clock is at the same rate as the clock of other DMICs used for noise suppression.

In some embodiments, the DMIC 120 responds to the presence of the CLK input 312 by immediately switching from the internal sample rate to the sample rate of the provided CLK line 312. In certain embodiments, the DMIC 120 is operable to immediately begin supplying real-time PDM 308 data on a first channel (for example, the left channel) of the DATA output 314, and the delayed (typically about 100 k PDM samples) buffered PDM 308 data on the second (for example, right) channel. The DMIC 110 can cease providing the internal clock on the DET signal when the CLK is received.

In some embodiments, after the entire (typically about 100 k sample) buffer has been transmitted, the DMIC 120 switches to sending the real-time audio data or a static signal (typically a logical 0) on the second (in the example, right) channel of DATA output 314 in order to save power.

In various embodiments, the DSP 350 accumulates the buffered data and then uses the ratio of the previously measured DMIC 120 internal sample rate to the host CLK sample rate as required to process the buffered data in a manner matching the buffered data to the real-time audio data. For example, the DSP 350 can convert the buffered data to the same rate as the host CLK sample rate. It should be appreciated by those skilled in the art that the actual sample rate conversion may not be optimal. Instead, further downstream frequency domain processing information can be biased in frequency based on the measured ratio. The buffered data may be pre-pended to the real-time audio data for the purposes of keyword recognition. It may also be pre-pended to data used for the ASR as desired.

In various embodiments, because the real-time audio data is not delayed, the real-time data has a low latency and can be combined with the real-time audio data from other microphones for noise suppression or other purposes.

Returning the CLK signal to a static state may be used to return the DMIC 120 to the first stage processing state.

Example 2

Under first stage conditions, the DMIC 120 operates on an internal oscillator, which determines the PDM 308 sample rate. In some exemplary embodiments, under first stage conditions, prior to vocalization detection, the CLK input 312 is static, typically, a logical 0. The DMIC 120 can output a static signal, typically a logical 0, on both the DATA output 314 and DET output 316. Internally, the DMIC 120 operating from its internal oscillator, is operable to analyze the audio data to determine if a vocalization occurs and also to internally buffer the audio data into a recirculating memory. The recirculating memory can have a pre-determined number (typically about 100 k of PDM) of samples.

In some embodiments, when the DMIC 120 detects vocalization, the DMIC begins outputting a PDM sample rate clock derived from its internal oscillator, on the DET output 316. The DSP 350 can detect the activity on the DET line 312. The DSP 350 then can use the DET output to determine the internal sample rate of the DMIC 120 with a sufficient accuracy for further operations. Then, the DSP 350 outputs a clock on the CLK line 312. In certain embodiments, the clock is at a higher rate than the internal oscillator sample rate, and appropriate to receive real-time PDM 308 audio data from the DMIC 120 via the conventional DMIC 120 interface protocol. In some embodiments, the clock provided to CLK line 312 is at the same rate as the clock for other DMICs used for noise suppression.

In some embodiments, the DMIC 120 responds to the presence of the clock at CLK line 312 by immediately beginning to supply buffered PDM 308 data on a first channel (for example, the left channel) of the DATA output 314. Because the CLK frequency is greater than the internal sampling frequency, the delay of the data gradually decreases from the buffer length to zero. When the delay reaches zero, the DMIC 120 responds by immediately switching its sample rate from internal oscillator's sample rate to the rate provided by the CLK line 312. The DMIC 120 can also immediately begin supplying real-time PDM 308 data on one of channels of the DATA output 314. The DMIC 120 also ceases providing the internal clock on the DET output 316 signal at this point.

In some embodiments, the DSP 350 can accumulate the buffered data and determine, based on sensing when the DET output 316 signal ceases, a point at which the DATA has switched from buffered data to real-time audio data. The DSP 350 can then use the ratio of the previously measured DMIC 120 internal sample rate to the CLK sample rate to logically sample rate of conversion of the buffered data to match that of the real-time audio data.

In this example, once the buffer data is completely received and the switch to real-time audio has occurred, the real-time audio data will have a low latency and can be combined with the real-time audio data from other microphones for noise suppression or other purposes.

Various embodiments illustrated by Example 2 may have a disadvantage, compared with some other embodiments, of a longer time from the vocalization detection to real-time operation, which requires a higher rate during the real-time operation than the rate of the stage one operations, and may also require accurate detection of the time of transition between the buffered and real-time audio data.

On the other hand, the various embodiments according to Example 2 have the advantage of only requiring the use of one channel of the stereo conventional DMIC 120 interface, leaving the other channel available for use by a second DMIC 120.

Example 3

Under the first stage conditions, the DMIC 120 can operate on an internal oscillator, which determines the PDM 308 sample rate. Under the first stage conditions, prior to the vocalization detection, the CLK input 312 is static, typically at a logical 0. The DMIC 120 outputs a static signal, typically a logical 0, on both the DATA output 314 and DET output 316. Internally, the DMIC 120, operating from the internal oscillator, is operable to analyze the audio data to determine if a vocalization occurs, and also by internally buffering that data into a recirculating memory (for example, the buffer 310) having a pre-determined number (typically about 100 k of PDM) samples.

When the DMIC 120 detects a vocalization, the DMIC 120 begins to output PDM 308 sample rate clock, derived from its internal oscillator, on the DET output 316. The DSP 350 can detect the activity on the DET output 316. The DSP 350 then can use the DET output 316 signal to determine the internal sample rate of the DMIC 120 with a sufficient accuracy for further operations. Then, the host DSP 350 may output a clock on the CLK line 312 appropriate to receiving real-time PDM 308 audio data from the DMIC 120 via the conventional DMIC 120 interface protocol. This clock may be at the same rate as the clock for other DMICs used for noise suppression.

In some embodiments, the DMIC 120 responds to the presence of the CLK input 312 by immediately beginning to supply buffered PDM 308 data on a first channel (for example, the left channel) of the DATA output 314. The DMIC 120 also ceases providing the internal clock on the DET output 316 signal at this point. When the buffer 310 of the data is exhausted, the DMIC 120 begins supplying real-time PDM 308 data on the one of the channels of the DATA output 314.

The DSP 350 accumulates the buffered data, noting, based on counting the number of samples received, a point at which the DATA has switched from buffered data to real-time audio data. The DSP 350 then uses the ratio of the previously measured DMIC 120 internal sample rate to the CLK sample rate to logically sample rate conversion of the buffered data to match that of the real-time audio data.

In some embodiments, even after the buffer data is completely received and the switch to real-time audio has occurred, the DMIC 120 data remains at a high latency. In some embodiments, the latency is equal to the buffer size in samples times the sample rate of CLK line 312. Because other microphones have low latency, the other microphone cannot be used with this data for conventional noise suppression.

In some embodiments, the mismatch between signals from microphones is eliminated by adding a delay to each of the other microphones used for noise suppression. After delaying, the streams from the DMIC 120 and the other microphones can be combined for noise suppression or other purposes. The delay added to the other microphones can either be determined based on known delay characteristics (e.g., latency due to buffering, etc.) of the DMIC 120 or can be measured algorithmically, e.g., based on comparing audio data received from the DMIC 120 and from the other microphones, for example, comparing timing, sampling rate clocks, etc.

Various embodiments of Example 3 have the disadvantage, compared with the preferred embodiment of Example 1, of a longer time from vocalization detection to real-time operation, and of having significant additional latency when operating in real-time. The embodiments of Example 3 have the advantage of only requiring the use of one channel of the stereo conventional DMIC interface, leaving the other channel available for use by a second DMIC.

Figure 4:
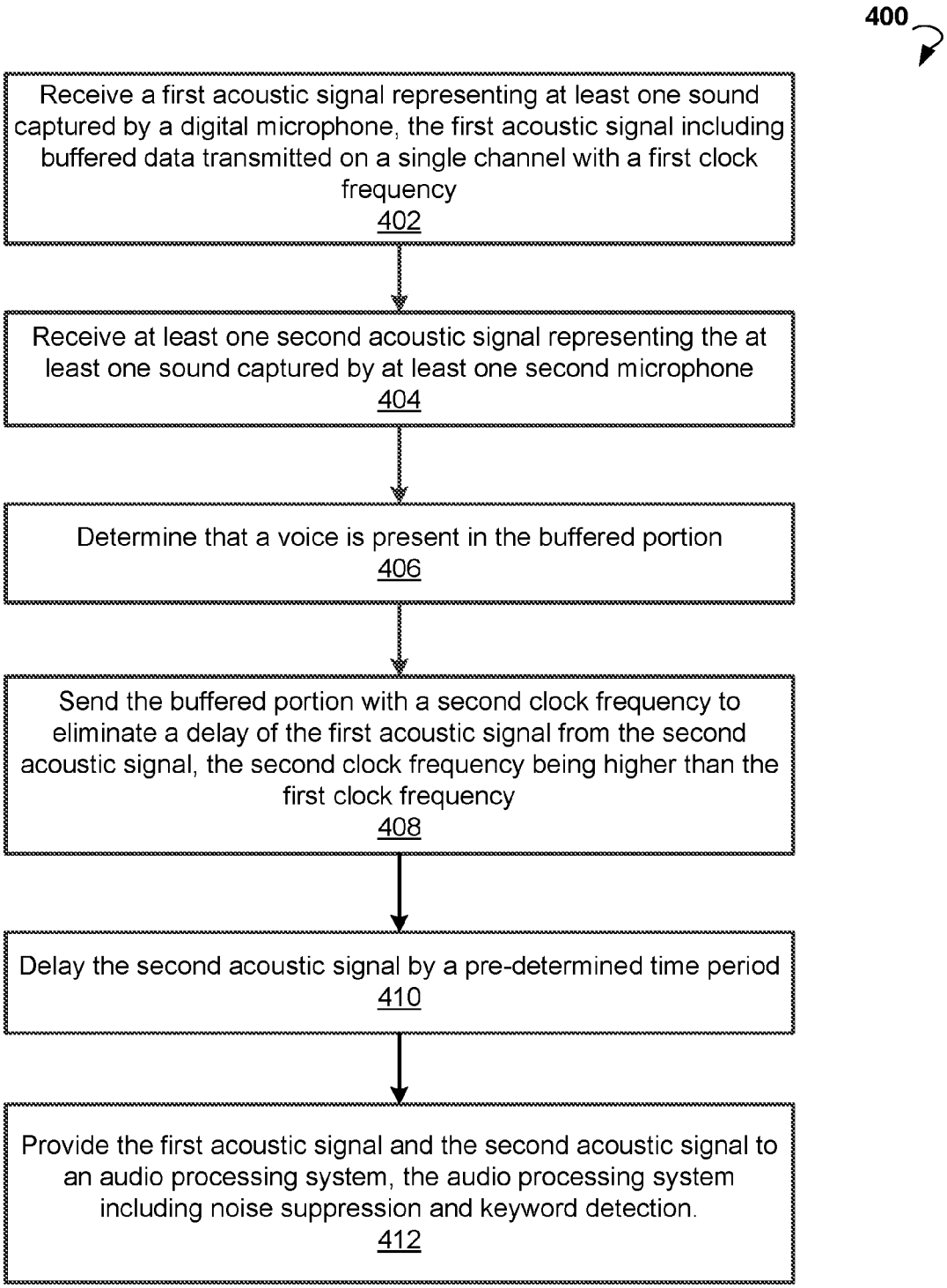
FIG. 4 is a flow chart showing steps of a method for utilizing digital microphones for low power keyword detection and noise suppression, according to an example embodiment.

FIG. 4 is a flow chart illustrating a method 400 for utilizing digital microphones for low power keyword detection and noise suppression, according to an example embodiment. In block 402, the example method 400 can commence with receiving an acoustic signal representing at least one sound captured by a digital microphone. The acoustic signal may include buffered data transmitted on a single channel with a first (low) clock frequency. In block 404, the example method 400 can proceed with receiving at least one second acoustic signal representing the at least one sound captured by at least one second microphone. In various embodiments, the at least one second acoustic signal includes real-time data.

In block 406, the buffered data can be analyzed to determine that the buffered data includes a voice. In block 408, the example method 400 can proceed with sending the buffered data with a second clock frequency to eliminate a delay of the acoustic signal from the second acoustic signal. The second clock frequency is higher than the first clock frequency. In block 410, the example method 400, may delay the second acoustic signal by a pre-determined time period. Block 410 may be performed instead of block 408 for eliminating the delay. In block 412, the example method 400 can proceed with providing the first acoustic signal and the at least one second acoustic signal to an audio processing system. The audio processing system may include noise suppression and keyword detection.

Figure 5:
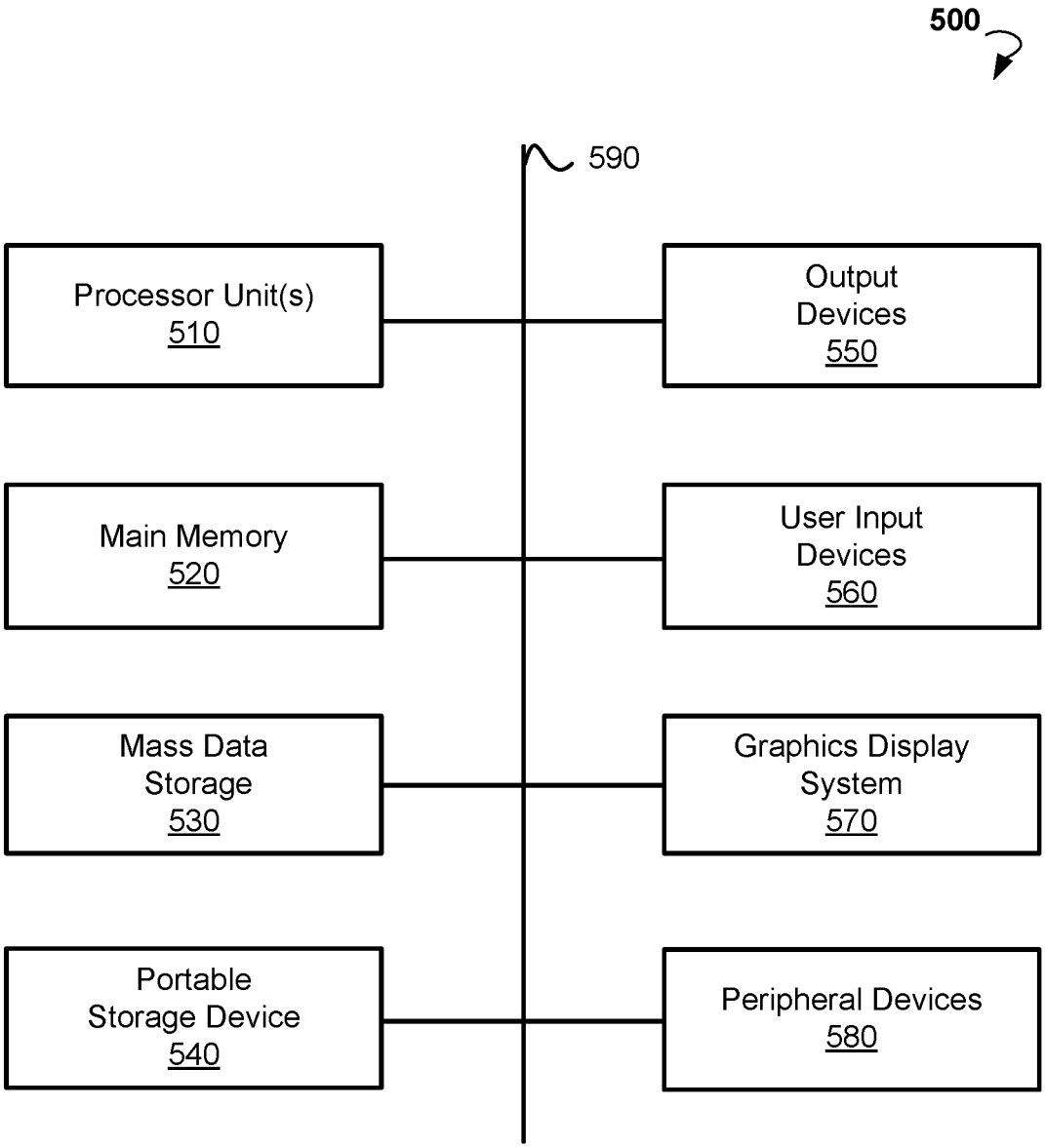
FIG. 5 is an example computer system that may be used to implement embodiments of the disclosed technology.

FIG. 5 illustrates an exemplary computer system 500 that may be used to implement some embodiments of the present invention. The computer system 500 of FIG. 5 may be implemented in the contexts of the likes of computing systems, networks, servers, or combinations thereof. The computer system 500 of FIG. 5 includes one or more processor units 510 and main memory 520. Main memory 520 stores, in part, instructions and data for execution by processor unit(s) 510. Main memory 520 stores the executable code when in operation, in this example. The computer system 500 of FIG. 5 further includes a mass data storage 530, portable storage device 540, output devices 550, user input devices 560, a graphics display system 570, and peripheral devices 580.

The components shown in FIG. 5 are depicted as being connected via a single bus 590. The components may be connected through one or more data transport means. Processor unit(s) 510 and main memory 520 is connected via a local microprocessor bus, and the mass data storage 530, peripheral device(s) 580, portable storage device 540, and graphics display system 570 are connected via one or more input/output (I/O) buses.

Mass data storage 530, which can be implemented with a magnetic disk drive, solid state drive, or an optical disk drive, is a non-volatile storage device for storing data and instructions for use by processor unit(s) 510. Mass data storage 530 stores the system software for implementing embodiments of the present disclosure for purposes of loading that software into main memory 520.

Portable storage device 540 operates in conjunction with a portable non-volatile storage medium, such as a flash drive, floppy disk, compact disk, digital video disc, or Universal Serial Bus (USB) storage device, to input and output data and code to and from the computer system 500 of FIG. 5. The system software for implementing embodiments of the present disclosure is stored on such a portable medium and input to the computer system 500 via the portable storage device 540.

User input devices 560 can provide a portion of a user interface. User input devices 560 may include one or more microphones, an alphanumeric keypad, such as a keyboard, for inputting alphanumeric and other information, or a pointing device, such as a mouse, a trackball, stylus, or cursor direction keys. User input devices 560 can also include a touchscreen. Additionally, the computer system 500 as shown in FIG. 5 includes output devices 550. Suitable output devices 550 include speakers, printers, network interfaces, and monitors.

Graphics display system 570 include a liquid crystal display (LCD) or other suitable display device. Graphics display system 570 is configurable to receive textual and graphical information and processes the information for output to the display device.

Peripheral devices 580 may include any type of computer support device to add additional functionality to the computer system.

The components provided in the computer system 500 of FIG. 5 are those typically found in computer systems that may be suitable for use with embodiments of the present disclosure and are intended to represent a broad category of such computer components that are well known in the art. Thus, the computer system 500 of FIG. 5 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, TIZEN, and other suitable operating systems.

The processing for various embodiments may be implemented in software that is cloud-based. In some embodiments, the computer system 500 is implemented as a cloud-based computing environment, such as a virtual machine operating within a computing cloud. In other embodiments, the computer system 500 may itself include a cloud-based computing environment, where the functionalities of the computer system 500 are executed in a distributed fashion. Thus, the computer system 500, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud may be formed, for example, by a network of web servers that comprise a plurality of computing devices, such as the computer system 500, with each server (or at least a plurality thereof) providing processor and/or storage resources. These servers may manage workloads provided by multiple users (e.g., cloud resource customers or other users). Typically, each user places workload demands upon the cloud that vary in real-time, sometimes dramatically. The nature and extent of these variations typically depends on the type of business associated with the user.

The present technology is described above with reference to example embodiments. Therefore, other variations upon the example embodiments are intended to be covered by the present disclosure.

What is claimed is:

1. A method for audio processing, the method comprising:

receiving a first acoustic signal representing at least one sound captured by a digital microphone having a buffer for storing digital data, the first acoustic signal including buffered digital data corresponding to the captured sound from the buffer of the digital microphone transmitted on a single channel with a first clock frequency;

receiving at least one second acoustic signal representing the at least one sound captured by at least one second microphone, the at least one second acoustic signal including real-time data; and providing the first acoustic signal and the at least one second acoustic signal to an audio processing system.

2. The method of claim 1, wherein the providing includes sending the buffered digital data with a second clock frequency for eliminating a delay of the first acoustic signal from the at least one second acoustic signal, the second clock frequency being higher than the first clock frequency.

3. The method of claim 1, wherein the providing includes delaying the at least one second acoustic signal by a pre-determined time period.

4. The method of claim 3, wherein the pre-determined time period is determined based on one or more characteristics of the digital microphone.

5. The method of claim 4, wherein the one or more characteristics includes latency of the digital microphone.

6. The method of claim 5, wherein the latency includes delay due to buffering for the buffered digital data at the digital microphone.

7. The method of claim 3, wherein the pre-determined time period is determined based on comparing the first acoustic signal and the at least one second acoustic signal.

8. The method of claim 7, wherein the comparing comprises comparing sampling rates of the first acoustic signal and the at least one second acoustic signal.

9. The method of claim 1, further comprising, prior to the providing, receiving an indication from the digital microphone that voice activity has been detected.

10. The method of claim 9, wherein the indication is provided by a voice activity detector associated with the digital microphone.

11. The method of claim 1, wherein the at least one second microphone is an analog microphone.

12. The method of claim 1, wherein the audio processing system provides noise suppression based on the first acoustic signal and the at least one second acoustic signal.

13. The method of claim 12, wherein the noise suppression is based on level difference between the first acoustic signal and the at least one second acoustic signal.

14. The method of claim 1, wherein the first acoustic signal includes a pulse-density modulation (PDM) signal.

15. A system for audio processing, the system comprising:

a processor; and a memory communicatively coupled with the processor, the memory storing instructions which, when executed by the processor, perform a method comprising:

receiving a first acoustic signal representing at least one sound captured by a digital microphone having a buffer for storing digital data, the first acoustic signal including buffered digital data corresponding to the captured sound from the buffer of the digital microphone transmitted on a single channel with a first clock frequency;

receiving at least one second acoustic signal representing the at least one sound captured by at least one second microphone, the at least one second acoustic signal including real-time data; and providing the first acoustic signal and the at least one second acoustic signal to an audio processing system.

16. The system of claim 15, wherein the audio processing system includes at least one of noise suppression and keyword detection based on the first acoustic signal and the at least one second acoustic signal.

17. The system of claim 15, wherein the providing includes sending the buffered digital data with a second clock frequency for eliminating a delay of the first acoustic signal from the at least one second acoustic signal, the second clock frequency being higher than the first clock frequency.

18. The system of claim 15, wherein the providing includes delaying the at least one second acoustic signal by a pre-determined time period.

19. The system of claim 18, wherein the pre-determined time period is determined based on one or more characteristics of the digital microphone.

20. The system of claim 18, wherein the pre-determined time period is determined by comparing the first acoustic signal and the at least one second acoustic signal.

21. The system of claim 15, further comprising, prior to the providing, receiving an indication that voice activity has been detected.

22. The system of claim 21, wherein the indication is provided by a voice activity detector associated with the digital microphone.

23. The system of claim 15, wherein the at least one second microphone is an analog microphone.

24. A non-transitory computer-readable storage medium having embodied thereon instructions, which, when executed by at least one processor, perform steps of a method, the method comprising:

receiving a first acoustic signal representing at least one sound captured by a digital microphone having a buffer for storing digital data, the first acoustic signal including buffered digital data corresponding to the captured sound from the buffer of the digital microphone transmitted on a single channel with a first clock frequency;

receiving at least one second acoustic signal representing the at least one sound captured by at least one second microphone, the at least one second acoustic signal including real-time data; and providing the first acoustic signal and the at least one second acoustic signal to an audio processing system.

* * * * *